United States Patent [19]

Fingerson et al.

[11] 3,977,653

[45] Aug. 31, 1976

[54] POST AND CLIP CONSTRUCTION FOR THE WIRE FENCES

[75] Inventors: Conrad F. Fingerson; Paul P. Durhman, both of Chatfield; James E. Gove, Rochester; Daniel Meyer, Chatfield, all of Minn.

[73] Assignee: AFC, Inc., Chatfield, Minn.

[22] Filed: June 27, 1974

[21] Appl. No.: 483,678

[52] U.S. Cl. ..... 256/10; 256/57

[51] Int. Cl.[2] ..... E04H 17/10

[58] Field of Search ..... 256/10, 57, 54, 47; 24/30.5, 27

[56] References Cited

UNITED STATES PATENTS

| | | | |
|---|---|---|---|
| 1,454,254 | 5/1923 | Roney | 256/57 |
| 1,543,390 | 6/1925 | Funk | 256/57 |
| 1,848,452 | 3/1932 | Young | 256/57 |
| 1,868,557 | 7/1932 | Williams | 256/57 |
| 2,004,629 | 6/1935 | Kibler | 256/57 |
| 2,805,277 | 9/1957 | Moeller | 256/10 X |
| 2,821,365 | 1/1958 | Lach | 256/10 X |
| 3,001,765 | 9/1961 | Shobert | 256/10 |
| 3,022,522 | 2/1962 | Neely | 5/353.7 |
| 3,120,230 | 2/1964 | Skold | 24/27 X |
| 3,227,423 | 1/1966 | DeMatteo | 256/12.5 |
| 3,531,090 | 9/1970 | Laible | 256/10 |
| 3,684,247 | 8/1972 | Oltmanns | 256/10 |

*Primary Examiner*—Dennis L. Taylor

*Attorney, Agent, or Firm*—Merchant, Gould, Smith, Edell, Welter & Schmidt

[57] ABSTRACT

A fence post and wire support for electric fences wherein the post is made of unidirectional glass fibers in a plastic resin and has a T-shaped cross section. The resulting structure is light but rigid, and has flat surfaces which eliminate the need for an anchor plate. A number of wire-like clips are adapted for crimping around the post or for resiliently engaging the post to form a wire support. The wire-like clips are designed to cooperate with the T-shaped cross section of the post to provide a secure mounting thereto. Alternatively, a rubber-like wire support having two ring portions which fit snugly around the post, and having a hinge portion joining the ring portions may serve as the wire holder.

6 Claims, 12 Drawing Figures

POST AND CLIP CONSTRUCTION FOR THE WIRE FENCES

BACKGROUND OF THE INVENTION

The present invention pertains in general to structures for supporting wires in electric fences, and in particular to synthetic material fence posts and cooperating wire holders which are low in cost but very advantageous and convenient in use.

Electric fences have gained widespread use in certain phases of cattle raising operations because they are lower in cost and are more easily constructed and relocated than conventional fences. Ideally, a fence post for use with electric fences should be light in weight for ease in handling and storage, as well as being low in cost. A post should also be strong enough to resist breaking while it is being driven into the ground, and to resist breaking or bending when subjected to wire tension, wind loads, or the occasional bumping of an animal. The post should also be corrosion resistant, and should have sufficient areas for contact with the soil so as to prevent tipping or turning of the post. The wire supports for use with the post should also be low in cost and easy to install, and must provide a secure support for the wire. Finally, either the wire holder or the post must provide electrical insulation from the ground.

One type of prior art electric fence post is made of a steel bar to which an anchor plate is welded. Since these bars are subject to rusting, it is necessary to apply an anti-corrosion plating or paint. Additionally, since the steel bars are electrical conductors, it is necessary to use rather elaborate molded insulative wire holders. These disadvantages, plus the weight of the steel which makes these prior art fence posts inconvenient to handle and store, have led to the development of electric fence posts made of synthetic material. One type of prior art synthetic fence post is a cylindrical rod made of fiberglass and plastic resin. Since this material is light in weight, corrosion resistant, nonconductive, and does not permanently bend, certain advantages are obtained over the use of steel posts. However, with the fiberglass cylindrical rod, a steel anchor plate must still be provided to help support the rod while in the ground. Also, a considerable amount of material must be used in each post to obtain the necessary rigidity.

The present invention provides an improved fiberglass and plastic resin fence post and cooperating wire holders which meet all the requirements set forth above, and which overcome the problems which exist both with respect to the prior art steel posts and the prior art fiberglass posts. By providing a T-shaped cross section, fence posts according to the present invention achieve even greater strength and rigidity for a given amount of material used in the making of the post. Additionally, the flat surfaces provided by the T-shaped cross section provide a large area for engagement of soil in which the post is placed, thereby eliminating the need for a separate anchor plate. Moreover, it has been found that the use of the T-shaped cross section allows the use of greatly simplified wire support means which are very low in cost, and which can be very quickly attached. A number of wire-like clips are provided for quickly and securely attaching the fence wire to the post. These clips are shaped to cooperate with the T-shaped cross section of the post to provide a good grip thereto. Since the post is an electrical insulator, the electric wire may be in direct contact with the wire clip and the post, without any need for a separate insulator. Alternatively, a rubber-like wire support may be used.

SUMMARY OF THE INVENTION

According to the present invention there is provided a fence post for supporting a wire in a fence, comprising an elongated post member composed of unidirectional glass fibers and a plastic resin, the post member generally having a T-shaped cross section. According to another feature of the invention, there is provided a wire-like clip adapted for securing a wire to the post.

In one embodiment of the invention, the wire-like clip comprises a generally C-shaped piece of wire sized in relation to the post member for crimping around and slightly into the edges of the post member. The fence wire is then supported along the flat side of the post member, between the post and the clip.

According to another embodiment of the invention, the wire-like clip has formed therein a central bend which is sized to conform to the dimensions of a web portion of the T-shaped cross section of the post. The extremities of the clip form a pair of wing portions which extend outwardly from the central bend. In use, the central bend fits over a web portion of the post, and the wing portions are held back by the fence wire around which they hook, the fence wire passing along the flat side of the post opposite the web around which the central bend is placed.

According to yet another embodiment of the invention, the wire-like clip comprises a piece of wire having a central loop formed therein, with each end of the wire being bent into a wire-retaining portion. The loop is sized in relation to the dimensions of the cross section of the post so that the resiliency of the clip causes it to grip the post.

According to a further embodiment of the invention, the wire-like clip comprises a piece of wire having a central portion which is crimpable around the post, and having a hook formed in one end for crimping the preferably sharpened end thereof into the flat side of the T-shaped post. This not only helps secure the clip to the post, but the hook provides a means for supporting the fence wire which is passed therethrough. A hook may also be provided in the other end of the clip for crimping into the post to provide further support.

According to yet another feature of the present invention there is provided a wire holder made of rubber-like material having two ring portions for fitting snugly on the post member, and a hinge portion connecting the two ring portions. The fence wire is held in place by the hinge portion and the post.

DESCRIPTION OF THE PREFERRED EMBODIMENT

Figure 1:
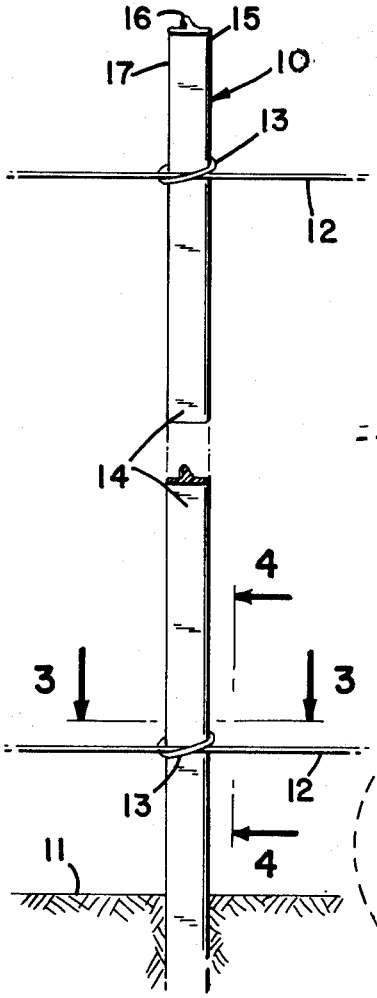
FIG. 1 is a view in perspective of a fence post according to the present invention.

In FIG. 1, reference number 10 designates an elongated post member according to the present invention, with a portion thereof being omitted from the drawing due to the normally great length of the posts. Reference number 12 generally designates a pair of fence wires, which may be electrified, supported by post member 10. Post member 10 is shown driven into the ground 11 for support thereby. Wire support means are employed to hold the fence wires 12 to the post member 10. In the embodiment shown in FIG. 1, the wire support means comprises a pair of wire-like clips 13 which are used to hold the fence wires 12 in place against the post.

Figure 2:
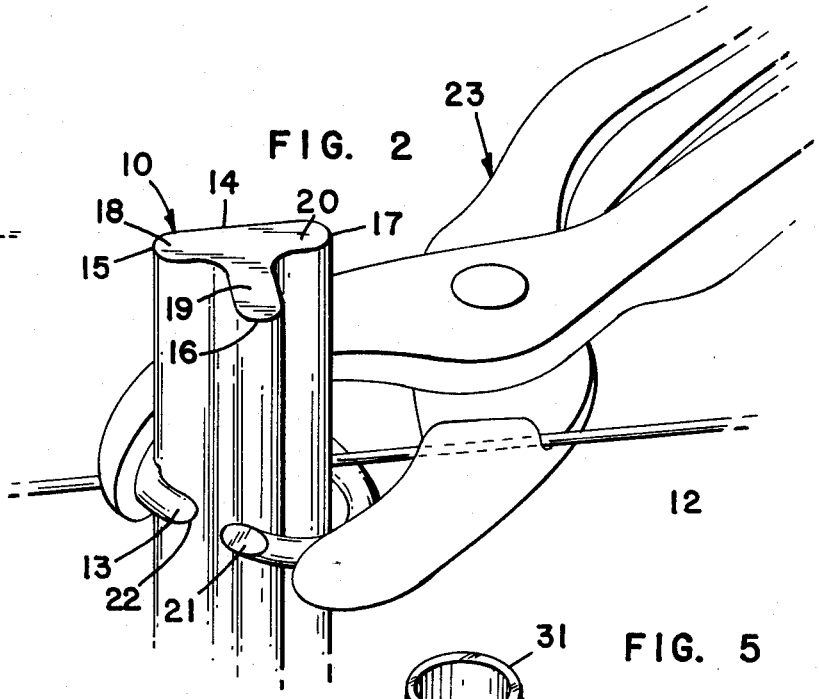
FIG. 2 is an enlarged view in perpsective illustrating the crimping of a clip to the post of FIG. 1.
Figure 3:
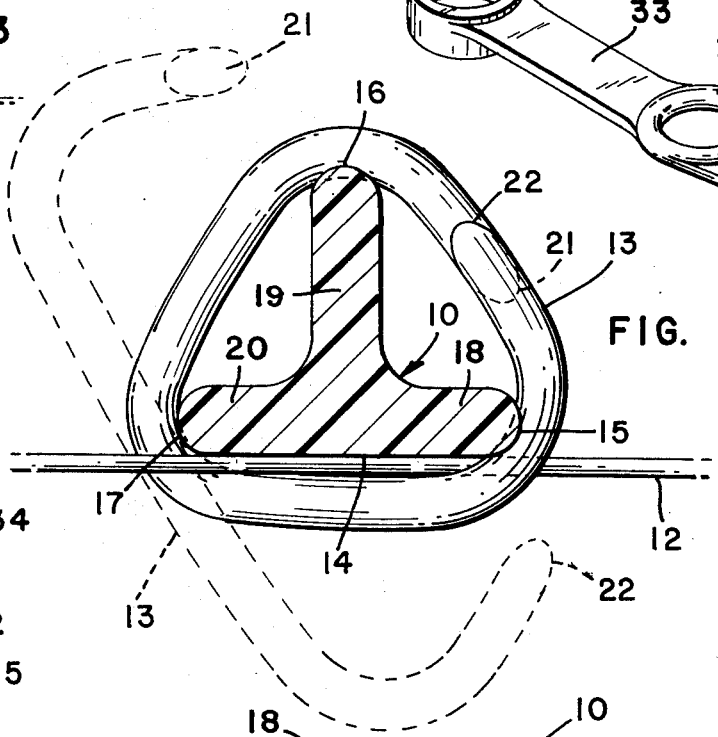
FIG. 3 is an enlarged horizontal sectional view taken generally along lines 3—3 of FIG. 1.
Figure 4:
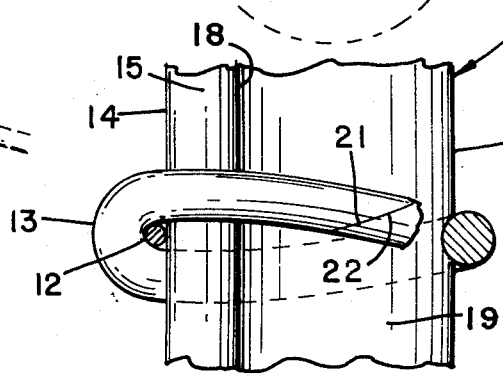
FIG. 4 is an enlarged vertical section taken generally along lines 4—4 of FIG. 1, with portions thereof broken away for clarity.

As seen more clearly in FIGS. 2, 3 and 4, post member 10 has web portions 18, 19 and 20 which together form a generally T-shaped cross section. Web portions 18, 19 and 20 have radiused edges 15, 16 and 17 respectively. The T-shaped cross section has a flat side 14, adjacent which the fence wire 12 is most advantageously placed.

The wire-like clip 13 in the embodiment of FIGS. 1, 2, 3 and 4 is a generally C-shaped wire having oppositely beveled ends 21 and 22. Attachment of the clip is easily accomplished with the aid of a pliers-like tool 23 (FIG. 2), which preferably has cupped jaws to aid in holding the clip while crimping. The clip is placed in the jaws of pliers 23 and positioned against post 10 so that the center of clip 13 is against the edge 17 of the post as shown in FIG. 3. Of course, since fence wire 12 is to be horizontal, it is necessary to tilt clip 13 slightly out of horizontal plane as shown in FIG. 4 so as to capture fence wire 12. As the pliers 23 are pushed together, clip 13 is forced to bend around edge 17, and also to bend around and dig into edges 16 and 15, as indicated by the broken lines in FIG. 3. Preferably, the length of clip 13 and the beveling of its edges are carefully chosen in relation to the dimensions of the post so that a tight crimp is accomplished with the clip digging slightly into the edges of the post just as the ends 21 and 22 are joined. The indentations caused by the clip on edges 15 and 16 of the post in FIG. 3 are due partly to the pressure applied and partly due to movement of the clip while in contact with the fence post edges during the final portion of the crimping process. These indentations assure that the fence wire 12 will be held securely in place, without the clip moving up and down along the post.

Of course, it would be possible to use any piece of wire, not necessarily preformed in a C-shape, to fasten the fence wire to the post. Likewise, it is not necessary that the ends of the clip be beveled, although they are in the preferred embodiment. It has been found that for one preferred embodiment of a fence post according to the present invention whose dimensions are given hereinafter, very satisfactory results are obtained by using as the wire support clip 13, Blair Shoat Rings, No. B–2, made by The Seymour Manufacturing Company, Seymour, Ind. For convenience, a plier-like tool made by the same company for use with the rings, and sold under the name "Seymour Ringers" may be used to crimp the clips around the post.

The post member 10 is preferably made by a pultrusion process, and consists of unidirectional glass fibers in a plastic resin. In one preferred embodiment, a polyester resin is used, although an epoxy resin might also be used. Posts according to the preferred embodiment contain approximately 60% to 75% glass by volume, and the glass fibers are aligned with the longitudinal axis of the post. This alignment, plus the T-shaped cross section results in a structure having great rigidity in relation to the relatively modest amount of material which it contains.

In one preferred embodiment, whose dimensions fit the number B-2 shoat rings described above, the dimensions are as follows. With reference to FIG. 3, the distance from edge 15 to edge 17 is 0.610 inches; the distance from edge 16 to the center of flat side 14 is 0.500 inches; the web thickness is 0.120 inches; the radius of edges 15, 16 and 17 is 0.060 inches; and the radius of the two concave portions is 0.125 inches. The post can be made any desired length, with 48 or 54 inch lengths being common. The structure described above is quite rigid and resistant to breakage, even in a 54 inch length. If bent, the post will spring back to its original shape rather than remaining permanently bent as a steel post would. Finally, it will be appreciated that the several flat surfaces afforded by T-shaped cross section provide ample soil engagement for anchoring a post so as to resist tipping or twisting. Thus, the need for a separate anchor plate is eliminated, and further convenience and lower cost is thereby achieved.

Figure 5:
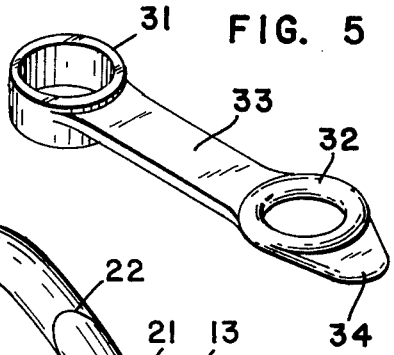
FIG. 5 is a view in perspective of a holder for use with the post of FIG. 1.
Figure 6:
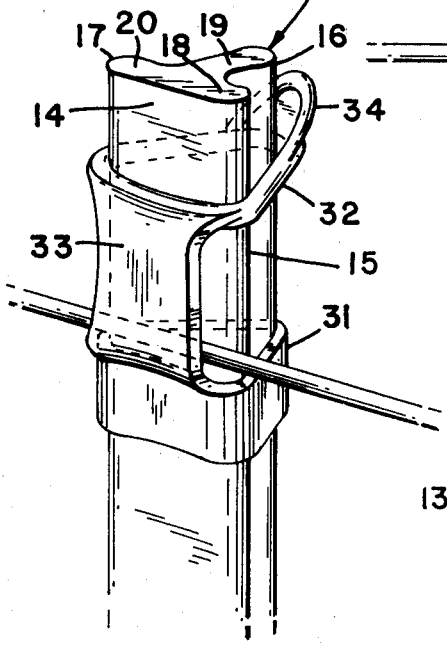
FIG. 6 is a view in perspective illustrating the use of the holder of FIG. 5 on the post of FIG. 1.

FIGS. 5 and 6 illustrate an alternate type of wire support means which may be used with post member 10 of FIG. 1. The support means or wire holder of FIG. 5 is preferably made of an elastic rubber-like material, and it has ring portions 31 and 32 which are connected by a hinge portion 33. Alternatively, the entire holder could be made from a single strip of material which would serve as a hinge portion with an aperture formed in each end of the strip.

Ring portions 31 and 32 have apertures sized in relation to the cross sectional size of post member 10 to fit snugly therearound when deformed slightly to fit down over the post. For convenience, a tab 34 may be provided to assist in positioning the holder. As shown in FIG. 6, the fence wire 12 is held in place between the post member 10 and the hinge portion 33 of the holder.

Figure 7:
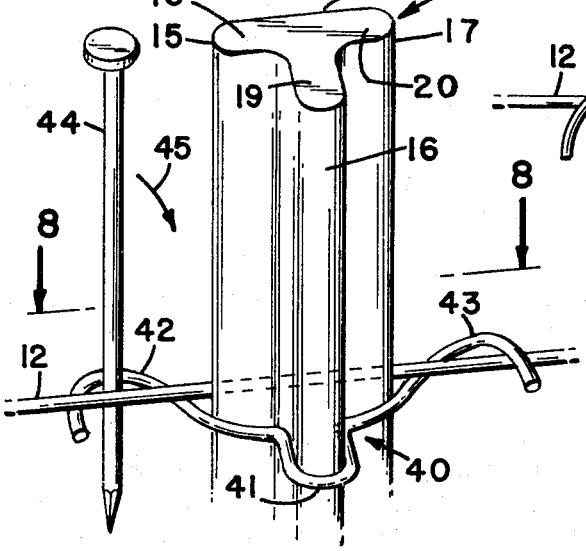
FIG. 7 is a view in perspective of another clip for securing a fence wire to the post.
Figure 8:
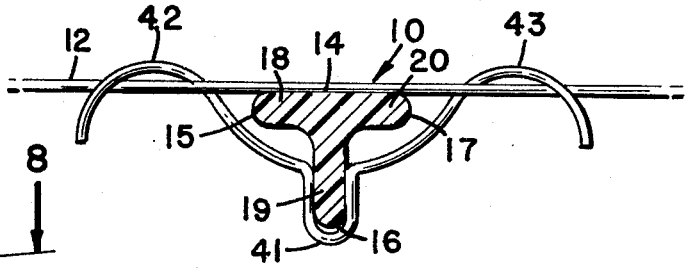
FIG. 8 is a horizontal section taken generally along lines 8—8 of FIG. 7.

The wire-like clip 40 of FIGS. 7 and 8 is especially adapted to support the fence wire 12 along the flat side 14 of post 10, by gripping the sides of web 19. The clip 40 has a central bend 41 which is sized to conform to the dimensions of web 19. The central portion 41 has a generally flat section for engaging one side of web 19, then bends around a radius comparable to radius 16 of the web 19, to a similar flat section for engaging the other face of web 19. The clip 40 then bends outwardly and backwardly toward both ends to form a pair of wing portions 42 and 43. The wing portions then bend forward again slightly to form a portion of a loop or hook which is adapted to fit around the wire 12. As shown in FIG. 8, the wing portions pass beneath the fence wire 12, behind it, and then over the fence wire to hold it in place. Of course the partial loop or hook portion formed in the ends of wings 42 and 43 could be a gentle bend as shown in FIGS. 7 and 8, or it could be a plurality of angular bends to accomplish this same purpose. To install the clip 40, one wing or the other is placed around the wire. For example, as shown in FIG. 7, the wing 43 is hooked around fence wire 12. The central bend portion 41 is then placed on the web 19. Finally, the other wing portion 42 is hooked over the fence wire 12 with the aid of a small rod 44, which can be a nail or any similarly shaped object. The rod 44 is inserted between the wing portion and the fence wire, then moved in the direction shown by arrow 45 to force the end of wing portion 42 around and over the fence wire 12.

The clip 40 is preferably made of a spring wire with a galvanized coating. In a preferred embodiment, the wire is approximately 0.045 inch to 0.050 inch in diameter. The clip is formed and shaped so that in its unflexed position, the wing portions do not extend back far enough to loop around the fence wire 12. Thus, when the clip is installed as previously described, the clip 40 must be flexed in order for the wing portions to capture the wire as shown in FIGS. 7 and 8. The resilience of the clip then holds the fence wire in close engagement to the flat surface 14. More importantly, the pulling back of wing portions 42 and 43 forces the central portion of the clip to grip the sides of web portion 19 tightly, thus preventing the clip from sliding up and down on the post. Because of its good holding properties, and because it can be easily installed and removed, the clip shown in FIGS. 7 and 8 is the presently preferred embodiment, although the other wire-supporting means disclosed herein also perform satisfactorily.

Figure 9:
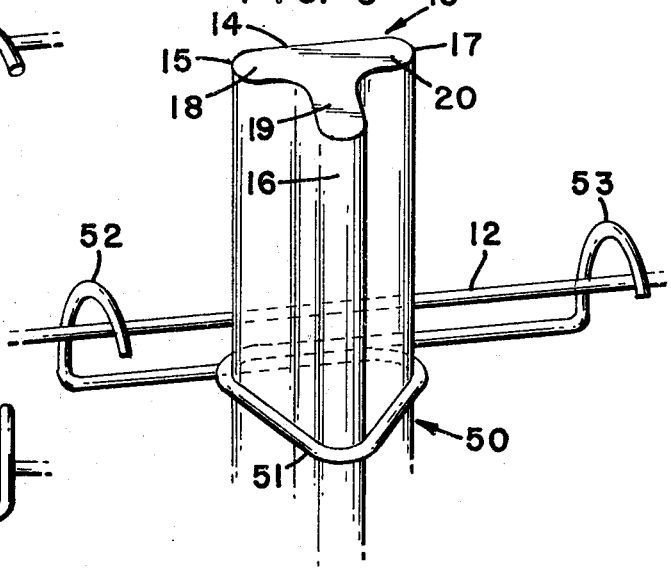
FIG. 9 is a view in perspective of yet another clip for supporting a fence wire on the post.
Figure 10:
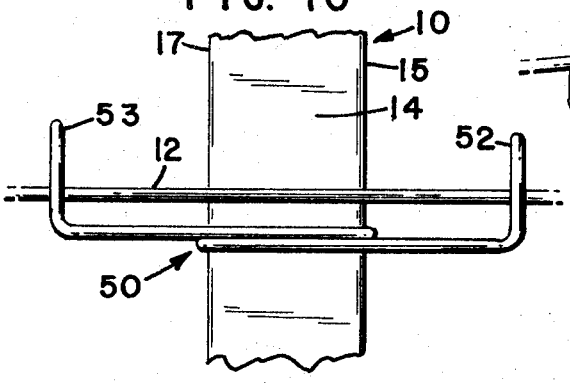
FIG. 10 is an elevation view taken generally from the side opposite that of FIG. 9.

In FIG. 9, the wire-like clip 50 is bent to form a central loop 51 which passes entirely around the post member 10. From the central loop, each end passes beyond the flat side of the post to end portions 52 and 53 which are bent into wire-retaining arcs or hooks. The clip 50 is also made of resilient spring wire, and the central loop is formed so that its unflexed nominal size is somewhat smaller than the cross sectional size of post 10. To install the clip, the end portions 52 and 53 are pushed slightly towards each other with the fingers and thumb, and the clip is slid down over the top of the post. At the desired height, the end portions are released and the resilience of the central loop grips the edges of the post to hold the clip in place. The fence wire 12 is held in place along the flat side of the post by the wire-retaining portions 52 and 53.

Figure 11:
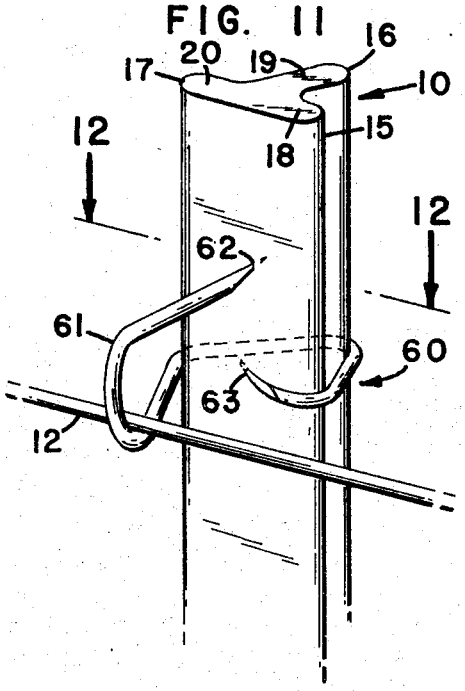
FIG. 11 is a view in perspective of a further embodiment of a clip for securing a fence wire to the post according to the present invention.
Figure 12:
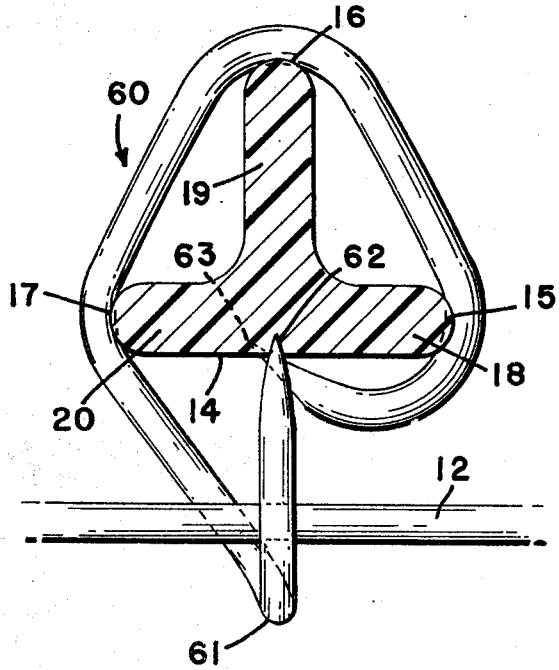
FIG. 12 is an enlarged horizontal section taken generally along lines 12—12 in FIG. 11.

FIGS. 11 and 12 show a wire-like clip 60 which is crimped around the post member 10. The clip 60 has a hook 61 formed in one end thereof, and this hook performs a dual function. The hook provides a means for capturing and supporting the fence wire 12 which passes through the hook, and the preferably sharpened end 62 of the hook is driven slightly into the surface 14 of the post member 10 to provide support and positioning. The other end of clip 60 may also be bent inwardly slightly to form a second hook 63 which also may dig slightly into the surface of the post. The clip 60 is installed preferably with a cup-type pliers similar to pliers 23 of FIG. 2. The clip is crimped so as to dig slightly into the edges 15, 16 and 17 of the web members of the post, and to drive the sharpened ends of hooks 62 and 63 into the surface 14 of the post. The fence wire 12 is then captured by the hook 61 and is thereby supported on the post. The second hook 63 is not necessary, as the sharpened end 62 together with the crimping into the edges of the post is sufficient to hold the clip in place, but it may be provided if desired to provide additional support.

Thus, according to the present invention, an improved fiberglass fence post for use in electric fences is provided that is light weight, strong, low in cost and easy to install. Wire supporting means are provided for cooperation with the fence post to provide an electric fence wire supporting structure that is quickly and easily constructed.

What is claimed is:

1. Apparatus for supporting a fence wire, comprising:

an elongated post member having a flat side thereon with a web portion extending transversely thereto and defining a T-shaped cross-section; said post member adapted to contact said fence wire along said flat side with said fence wire extending generally transversely to said post member; and a resilient wire-like clip having a central U-shaped portion sized to securely engage said web portion, with a pair of oppositely directed, outwardly extending wing portions which define wire-engaging hooks connected thereto and directed generally transversely of said post member on opposite sides thereof; said clip flexing in assembly with said hooks resiliently engaging said fence wire on opposite sides of said post member, whereby said U-shaped portion is flexed to securely engage said web portion.

2. The apparatus of claim 1 wherein said resilient wire-like clip is constructed of spring wire and each of said wing portions includes an outwardly and backwardly bent portion extending from said U-shaped portion to said wire engaging hooks.

3. The apparatus of claim 2 wherein said wire-engaging hooks each comprise a substantially semicircular loop extending forwardly from said outwardly and backwardly bent portion.

4. In a wire fence construction including an elongated post member of generally T-shaped cross-section with a flat side thereon and a transversely extending web portion, with a fence wire to be supported against said flat side, the improvement which comprises:

a spring wire clip defining a central post member gripping portion securely and resiliently engaging said post member, said gripping portion being connected to a pair of oppositely directed, outwardly extending wing portions directed generally transversely of said post member on opposite sides thereof, said gripping and wing portions cooperating so that flexure of said wing portions in one direction results in tightening the engagement of said post member by said gripping portion, and flexure in an opposite direction lessens said engagement, said wing portions each defining a wire-engaging hook member resiliently engaging said fence wire on opposite sides of said post member and resiliently securing said fence wire against said flat side.

5. Apparatus according to claim 4 wherein said clip has formed therein a gripping portion comprising a central bend sized to resiliently engage opposite sides of said web portion of the T-shaped cross-section of the post member, and said wing portions extend outwardly and backwardly from the central bend, then each terminate with forward arcuate hooks, whereby the portions of the clip adjacent the central bend are caused to grip the web portion of the post when the wing portions are drawn back and around a fence wire, so that said fence wire is firmly supported on the post.

6. Apparatus according to claim 4 wherein said clip comprises a piece of wire having formed therein a central loop with each end of the wire bent into a wire-retaining portion, the loop being sized in relation to the dimensions of the cross-section of the post member so that the resilience of the clip causes it to grip the post member.

* * * * *